US008961248B2

(12) United States Patent
Davies

(10) Patent No.: US 8,961,248 B2
(45) Date of Patent: Feb. 24, 2015

(54) SYSTEM FOR REVERSING A HIGH MASS/LOW-PRESSURE LIQUID PROPULSION DEVICE

(75) Inventor: Barry John Davies, Christchurch (NZ)

(73) Assignee: Propeller Jet Limited (NZ)

( * ) Notice: Subject to any disclaimer, the term of this patent is extended or adjusted under 35 U.S.C. 154(b) by 220 days.

(21) Appl. No.: 13/819,343

(22) PCT Filed: Aug. 31, 2011

(86) PCT No.: PCT/IB2011/053802

§ 371 (c)(1),
(2), (4) Date: Feb. 27, 2013

(87) PCT Pub. No.: WO2012/029031

PCT Pub. Date: Mar. 8, 2012

(65) Prior Publication Data

US 2013/0157530 A1 Jun. 20, 2013

(30) Foreign Application Priority Data

Sep. 2, 2010 (NZ) ..... 587752

(51) Int. Cl.
*B63H 11/107* (2006.01)
*B63H 11/11* (2006.01)
*B63H 11/117* (2006.01)

(52) U.S. Cl.
CPC ..... *B63H 11/107* (2013.01); *B63H 11/11* (2013.01); *B63H 11/117* (2013.01)
USPC ..... 440/38; 440/40; 440/47

(58) Field of Classification Search
USPC ..... 440/38, 47, 80, 81, 40, 41; 114/166
See application file for complete search history.

(56) References Cited

U.S. PATENT DOCUMENTS

| | | | | |
|---|---|---|---|---|
| 3,899,992 | A * | 8/1975 | Fuller | 440/51 |
| 6,022,250 | A | 2/2000 | Futaki | |
| 2011/0223815 | A1 | 9/2011 | Kinoshita | |

FOREIGN PATENT DOCUMENTS

| | | |
|---|---|---|
| AU | 200194202 | 4/2002 |
| KR | 20020063541 | 8/2002 |

* cited by examiner

*Primary Examiner* — Edwin Swinehart
(74) *Attorney, Agent, or Firm* — Galbreath Law Offices, P.C.; John A. Galbreath

(57) ABSTRACT

A high mass/low pressure liquid propulsion device which includes:—two counter-rotating impellers mounted inside a housing;—an inlet which in use allows inflow of liquid into the housing on a first side of said impellers; an outlet which in use allows outflow of liquid from the housing on a second side of said impellers opposite to said first side;—means for driving said impellers;—wherein the improvement comprises the provision of means for reversing the drive to said impellers, such that the direction of flow of liquid through the device is reversed and liquid enters the device through said outlet, passes through said impellers, and leaves the device through said inlet.

11 Claims, 7 Drawing Sheets

SYSTEM FOR REVERSING A HIGH MASS/LOW-PRESSURE LIQUID PROPULSION DEVICE

TECHNICAL FIELD

The present invention relates to a system for driving in reverse a high mass/low-pressure liquid propulsion device. The system of the present invention has been designed with especial reference to the high mass/low-pressure water propulsion drives described in U.S. Pat. Nos. 7,448,926, 7,566,251, and 7,824,237, and therefore will be described with particular reference to that application. However, the system of the present invention could be used with other designs of high mass/low-pressure water propulsion drives. In addition, it should be noted that the high mass/low-pressure water propulsion drives described in the above US patents could be adapted to function as pumps or turbines, and the present invention is equally applicable to such pumps or turbines.

The device of the present invention generally would be used to propel water (salt water or fresh), but could also be used to propel any of a wide range of other liquids.

BACKGROUND ART

To achieve reverse thrust in a boat it is normal to use a deflecting bucket, where the flow at the outlet is redirected backwards under the transom of the craft, through an angle normally greater than about 120 degrees to the direction of the outlet flow. This method generates sufficient thrust to make the craft go backwards, however the maximum reversing thrust is only about 40% of forward thrust. Additionally there are several unwanted drawbacks associated with reversing systems of this type.

1. The change in direction of the flow through the bucket generates an upward force as well as a reverse force. This upward force tends to lift the craft at the transom (stern) and apply a downwards force at the front (bow). In situations where the craft is used in shallow water operation, particularly to reverse off sandbars, reefs, shallows or the shore-line, the downwards force at the bow acts as an impediment to the reversing force. If the bow of the craft is lodged on the bottom or it is resting on the beach, the downwards force at the bow can cause the craft to founder and render the reverse ineffective.
2. The redirected water flow from the jet is at a downwards angle to avoid impacting the transom of the craft. If the reverse flow impacts the craft's transom or trimming structures mounted there, much of the reverse thrust is negated by the current associated with the flow.
3. The redirected water from the reverse bucket has a great deal of kinetic energy as well as a downwards component, which in shallow waters causes the bottom to be stirred up. In fragile and environmentally sensitive environments this high energy stream of water can cause unacceptable damage. Coral reefs, underwater weed and grass beds, shell fish, the end of launching ramps and shallow harbours etc can all be damaged by this high energy plume being re-directed downwards.
4. Once the bottom has been stirred-up, abrasive materials such as sand and in some cases coral become water-borne. All current commercial high-pressure water-jet pumps require tight tolerances between the pump housing walls and the impeller blade tips. Any ingested abrasive material will cause expensive damage to these pumps as the rotating components grind away the water lubricated bearings, pump housings and the impellers, resulting in loss of operational tolerances.
5. Additionally the reversing action in shallow waters can cause major damage to the internal components and structures inside conventional jets, as it is not only fine sands and material that can be ingested, but also larger bodies such as small stones. These stones and hard objects impact on the leading edges of the impellers and straightening vanes causing them to dull or blunt, resulting in loss of performance and economy.
6. If weed or general flotsam is disturbed by the action of the reverse bucket, this can be sucked onto the protective grill (a structure designed to prevent larger objects from entering the unit). Partial or total blockage of the grill can cause serious loss of propulsion.

Reversing the flow through a pressure jet system is well known in the industry, however the purpose is to back-flush the grill bars when they become blocked. There are various reasons pressure jets benefit very little from reversing the flow:—

1. Fundamental to all commercial pressure jet systems is high pressure head in the pump section and this requires that the outlet, relative to the impeller diameter, is a reducing ratio. When the flow is reversed there is no mechanism for creating a nozzle and thus pressure head. The inlet side of a pressure jet is always larger than the outlet. The smallest part of an intake duct is where the duct merges with the impeller. Comparing the area of the outlet to the area of the impeller, the ratio is usually between about 1:3 & 1:4 for axial pumps and even greater for mixed flow pumps. When the flow is reversed the intake to outlet ratios preclude any significant pressure head from being produced. Instead, significant suction pressure is induced at the nozzle which causes serious cavitation on the impeller blades when higher rpm is applied.
2. If somehow the nozzle was made larger or removed and the flow is reversed, it is important that the flow has substantial mass. The designs of pressure pump impellers are counter-functional for the purpose, i.e. they have fine pitched blade angles (usually between 11-19 degrees of pitch) which are designed to generate pressure head and not pump large mass. Consequently they move significantly less water for each revolution of the impeller compared to a propeller. Effective and efficient thrust requires high mass of water to be passed through the impellers particularly at low craft speed The impellers have to be rotated at least double to three times the speed of a normal propeller of equivalent diameter to achieve the same mass through-put. The high speeds of the impellers at relatively low boat speed causes high risk of severe cavitation damage.
3. All commercial pressure jet systems utilize a pressure inducing impeller followed by a set of fixed straightening vanes. The purpose of these vanes is to remove the radial energy component added to the water by the rotating blades. Axial flow is necessary once the water is ejected into the atmosphere; otherwise the plume dissipates in a perpendicular direction to the desired flow, producing little thrust. Fixed position straightening vanes are always found downstream from the rotating impellers, however by reversing the flow the straightening vanes would now be positioned upstream from the impellers, thus acting as additional impedance to the in-flowing water.
4. An additional problem for reversing the direction of the water-flow through a pressure jets is the proximity of the nozzle or outlet to the water surface. It is considerably easier for air to be sucked into the system (ventilation) than it is for water to be drawn backwards through the nozzle. Because jets are designed to expel water above the water-line, even when the boat is off the plane, the nozzle section is near the water surface or even partially out of the water. Suction at the nozzle as a result of reversing the drive, can lead to severe ventilation (air drawn into the system) and as a consequence, loss of propulsion.

DISCLOSURE OF INVENTION

An object of the present invention is the provision of a more efficient reverse drive for a high mass/low-pressure liquid propulsion device, which overcomes at least some of the above drawbacks.

The present invention provides a high mass/low pressure liquid propulsion device which includes:

- two counter-rotating impellers mounted inside a housing;
- an inlet which in use allows inflow of liquid into the housing on a first side of said impellers;
- an outlet which in use allows outflow of liquid from the housing on a second side of said impellers opposite to said first side;
- means for driving said impellers;
- wherein the improvement comprises the provision of means for reversing the drive to said impellers, such that the direction of flow of liquid through the device is reversed and liquid enters the device through said outlet, passes through said impellers, and leaves the device through said inlet.

In the present specification, the term "impeller" is used to refer to a hybrid impeller. The normal meaning of the term "impeller" essentially is a propeller within a housing, which functions to pressurise the water passing through the impeller; the speed of the water is reduced as it leaves the impeller. A propeller normally is not contained in a housing, and water leaving a propeller is accelerated. However, in the hybrid impeller of the present application, the impeller is contained in a housing, but water passing across the impeller is accelerated.

Preferably, said device also includes an anti-ventilation hood which is mounted on the housing adjacent said outlet and which can be moved between a first position in which said hood is clear of the outlet and a second position in which said hood provides a substantially airtight cover over at least the upper portion of said outlet.

If the device is always operated fully submerged in liquid, at a sufficient distance below the surface of the liquid that air is not likely to be drawn down through the liquid in use, then the anti-ventilation hood is not required. However, for a majority of applications (e.g. use of the device as a water propulsion drive), the device will be operated only partially submerged, or sufficiently close to the surface of the liquid for air to be drawn into the device in operation, and the anti-ventilation hood is needed.

Preferably, said device further includes a bypass located on the underside of the housing adjacent the impellers, said bypass being movable between a first position in which said bypass is closed and does not permit air or liquid to pass through into the housing, and a second position in which said bypass is open and allows liquid to pass through into the housing.

For a majority of applications, the inclusion of the bypass in the device will significantly improve the efficiency of operation. However, if the device is constructed such that the two counter-rotating impellers are identical and (preferably) the size of the outlet can be increased when the device is reversed, then the bypass can be omitted. If the bypass is to be omitted, it also is advantageous if any anti-ventilation cone which may be present can be collapsed or removed, so that it does not impede the reverse flow of liquid. It should be noted that for devices which are intended to be operated fully submerged, an anti-ventilation cone will not be fitted.

Preferably, the anti-ventilation hood and the by-pass are connected such that as said hood is moved between said first and second positions, said by-pass simultaneously passes between said first and second positions.

As used herein, the terms "upper" and "underside" refer to the orientation of the drive in its normal position on a boat, i.e. adjacent or below the waterline, with the inlet submerged.

BRIEF DESCRIPTION OF THE DRAWINGS

By way of example only, a preferred embodiment of the present invention is described in detail, with reference to the accompanying drawings, in which:—

BEST MODE FOR CARRYING OUT THE INVENTION

Figure 1:
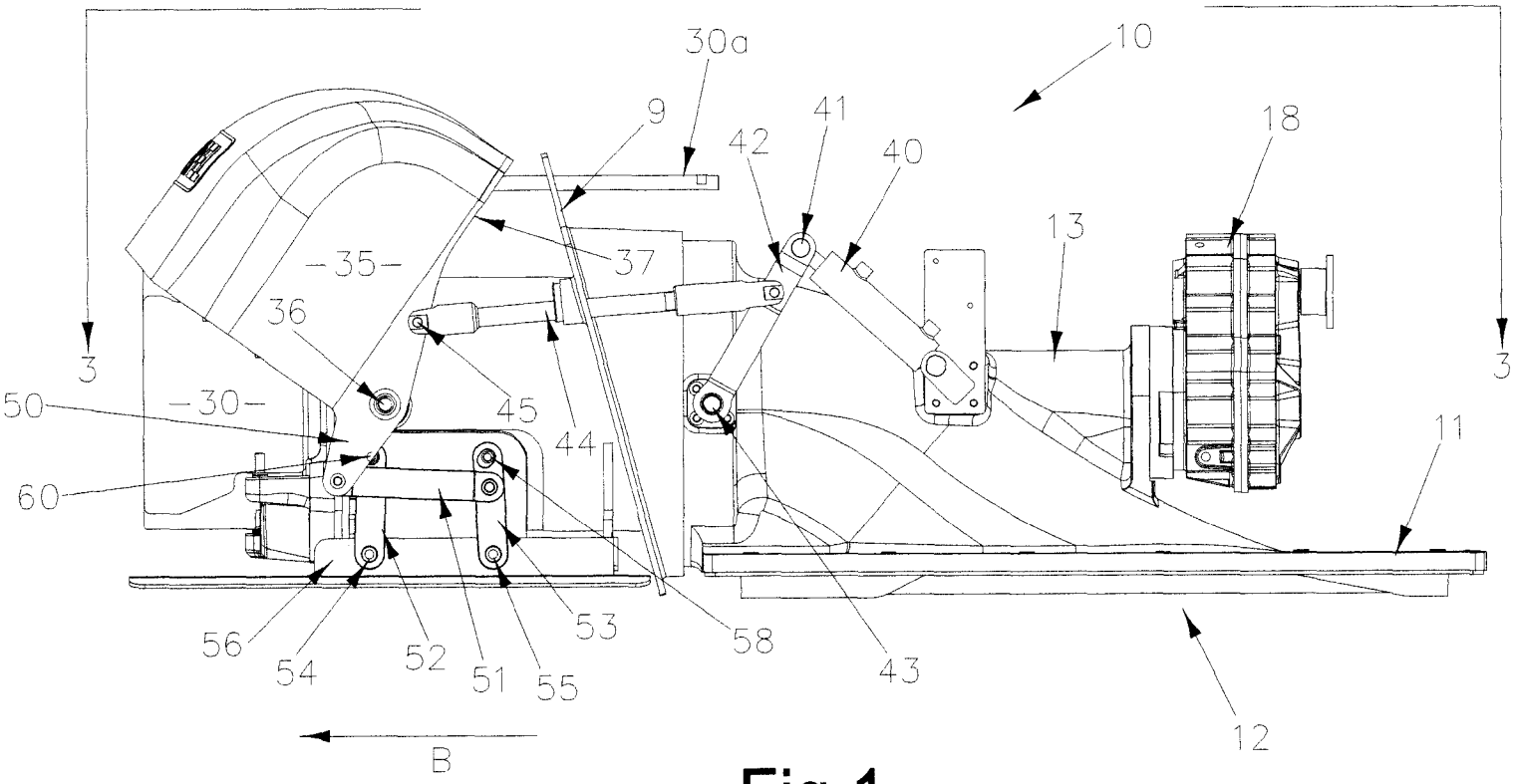
FIG. 1 is a side view of the drive of the present invention with the anti-ventilation hood in the first position.

Referring to the drawings, a water propulsion drive 10 is adapted to be mounted in the bottom of the boat, adjacent the stern (not shown) of the boat, with the mounting flange 11 cut into, and sealed to, the bottom of the boat so that the intake duct 12 is open to the water underneath the boat. Part of the drive 10 projects to the rear of the stern, and a transom seal 9 is fitted around the drive where it passes through the stern.

A housing 13 is mounted on the flange 12; the housing 13 may be made in two or more sections, for ease of access for maintenance. The housing 13 encloses two counter-rotating impellers 14,15, each mounted on a separate shaft 16,17 respectively (see FIG. 3). The shafts 16,17 are coaxial and are mounted one inside the other. The shafts 16,17 are designed to counter-rotate, so that the impellers 14,15 also are counter-rotating. The shafts 16,17 are driven by a motor (not shown) via a gearbox 18 which is designed to drive the shafts 16,17 in either direction, as selected.

The shafts 16,17 are supported by a tubular support snout 16*a* which is coaxial with the shafts 16,17 and is supported from the housing of the gearbox 18. The shaft 16 can rotate freely relative to the support snout 16 a on bearings carried by the support snout, and the shaft 17 can rotate freely relative to the shaft 16 on an end bearing 22 and on bearings (not shown in detail) arranged between the shafts 16 and 17.

It should be appreciated that the manner in which the impellers 14,15 are driven (in either direction) is not an essential feature of the present invention. The impellers may in fact be driven in any of a large number of different ways:—for example, the impellers can be driven separately using two separate reversible internal combustion motors or reversible electric motors, or may be driven from a single motor using any suitable gearing means to achieve counter rotation. Other possible reversible drives include reversing hydraulic motors and reversing magnetic drives. It should also be noted that the shafts 16,17 could be omitted and the impellers 14,15 driven directly.

The impellers 14,15 are designed to accept a high mass/low-pressure water flow, to draw water in through the intake 12, to accelerate the water as it passes through the impellers and, after leaving the impellers, passes out of the outlet 19, imparting forward motion to the boat. The fact that the impellers 14,15 are counter-rotating means that the water leaving the outlet 19 has a substantially linear flow.

The impellers 14,15 may be any of the different configurations described in U.S. Pat. Nos. 7,448,926, 7,566,251 and 7,824,237.

Figure 4:
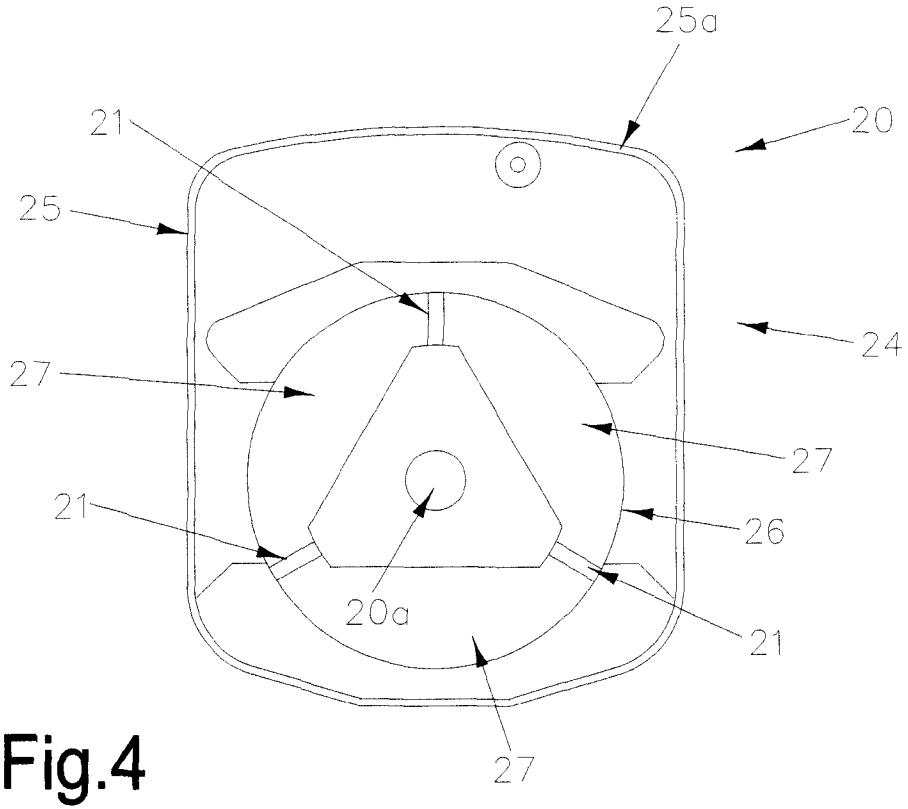
FIG. 4 is an end view of a seal, taken in the direction of arrow 4 of FIG. 3.

The end bearing 22 which supports the end of the shaft 17 remote from the gearbox 18 is mounted in an aperture 20*a* in the centre of a spider 20 adjacent the outlet 19. The spider 20 is triangular in side view (see FIG. 4) and is mounted in the centre of a sealing plate 24 by three spaced struts 21 which extend between each apex of the triangle and the adjacent inner edge 26 of the sealing plate 24.

The sealing plate 24 provides an outer edge 25 which seals around the inner edge of the housing and which also carries a compressible seal 25*a* against which an anti-ventilation hood can seal as hereinafter described. Since water exiting the housing 13 must pass through the sealing plate 24, the gaps 27 between the spider 20 and the inner edge 26 of the seal 24 are kept as large as possible.

Figure 3:
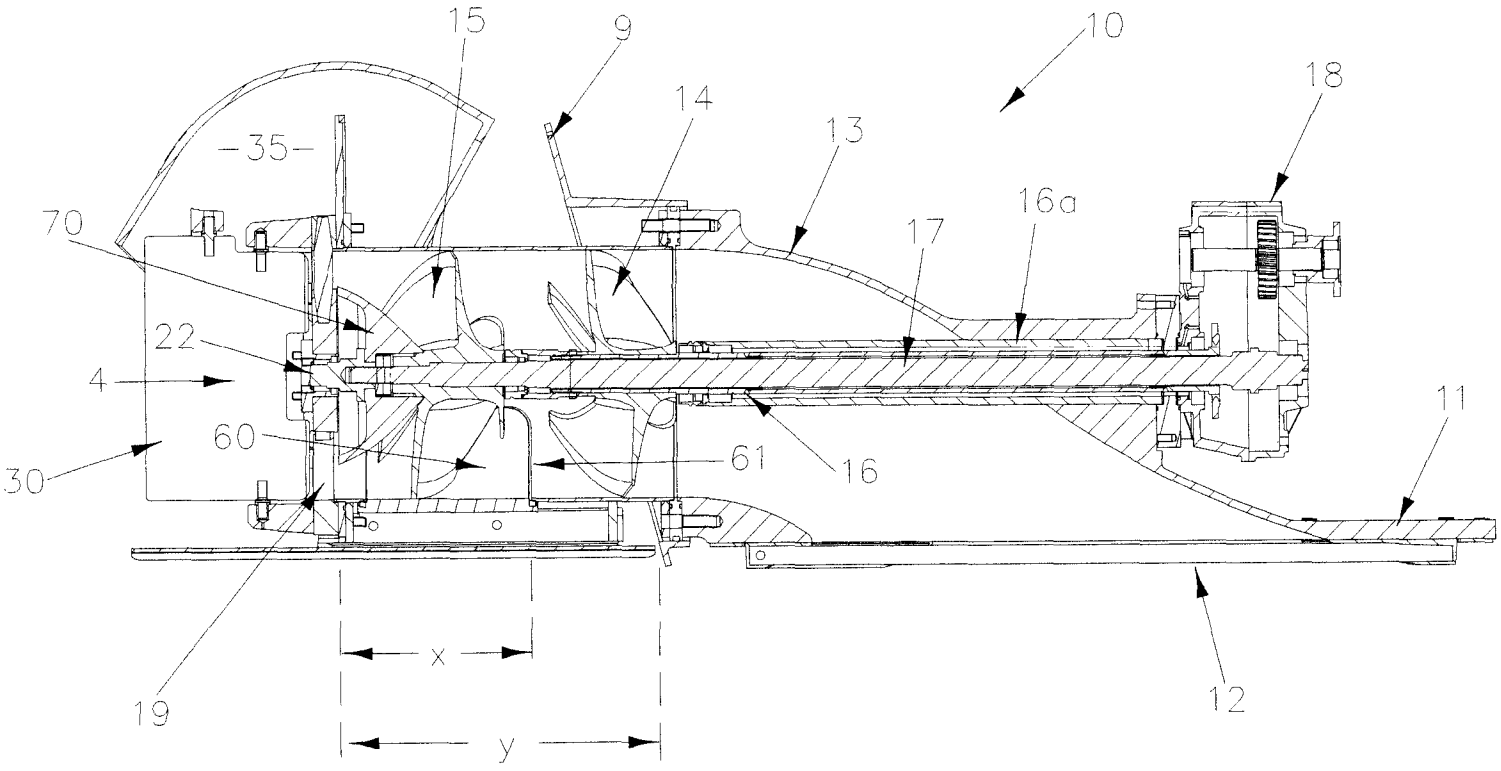
FIG. 3 is a vertical section on line 3-3 of FIG. 1.
Figure 5:
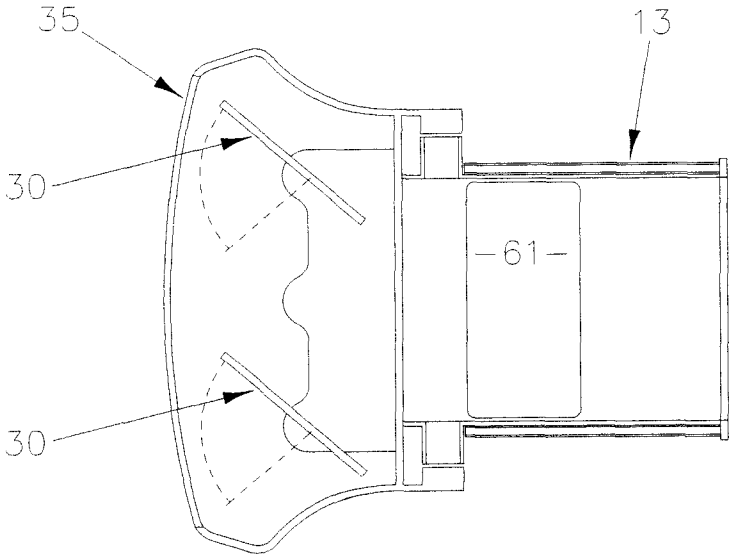
FIG. 5 is a simplified section on line 5-5 of FIG. 2, with some components omitted for clarity.
Figure 6:
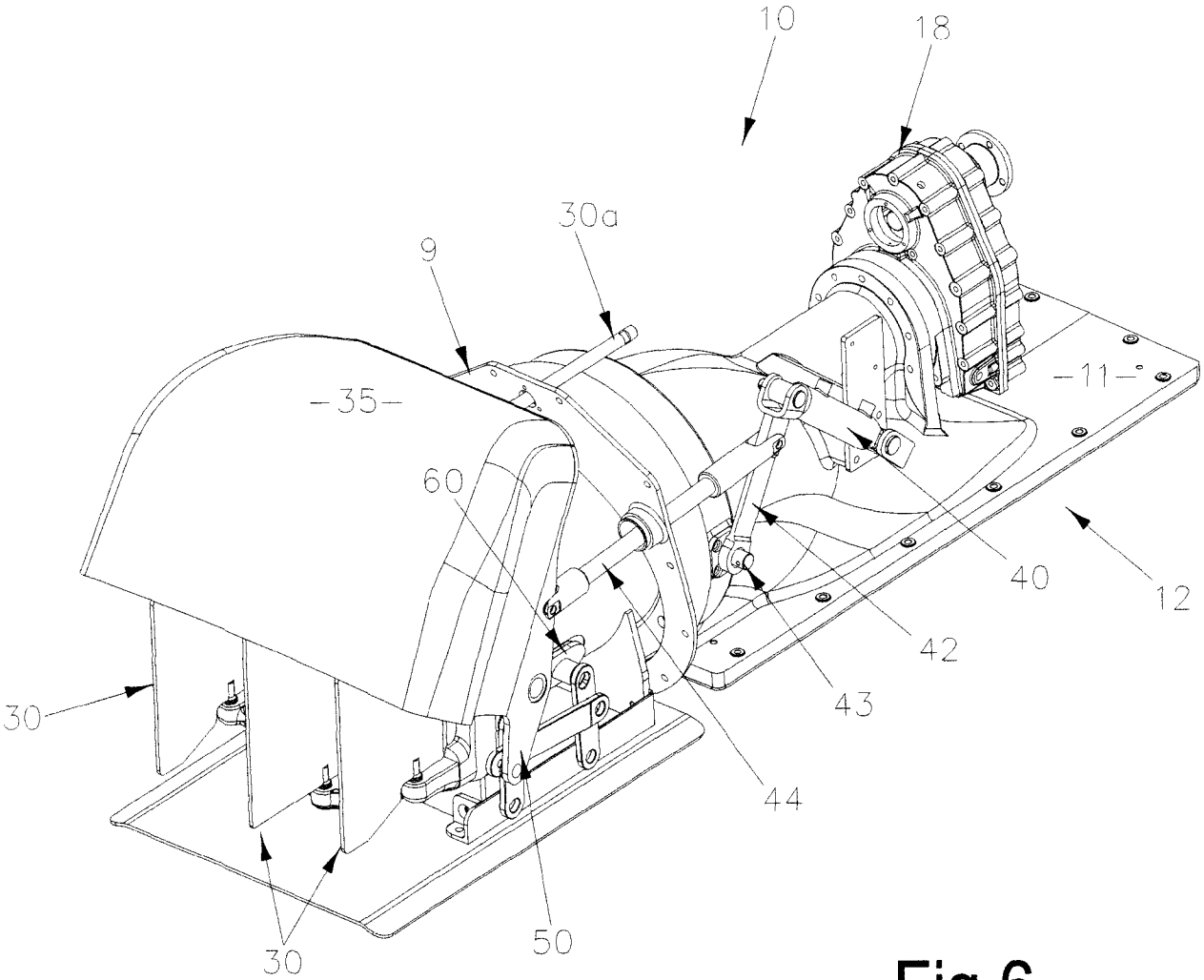
FIG. 6 is an isometric view of the drive as shown in FIG. 1, viewed from the rear of the drive.
Figure 7:
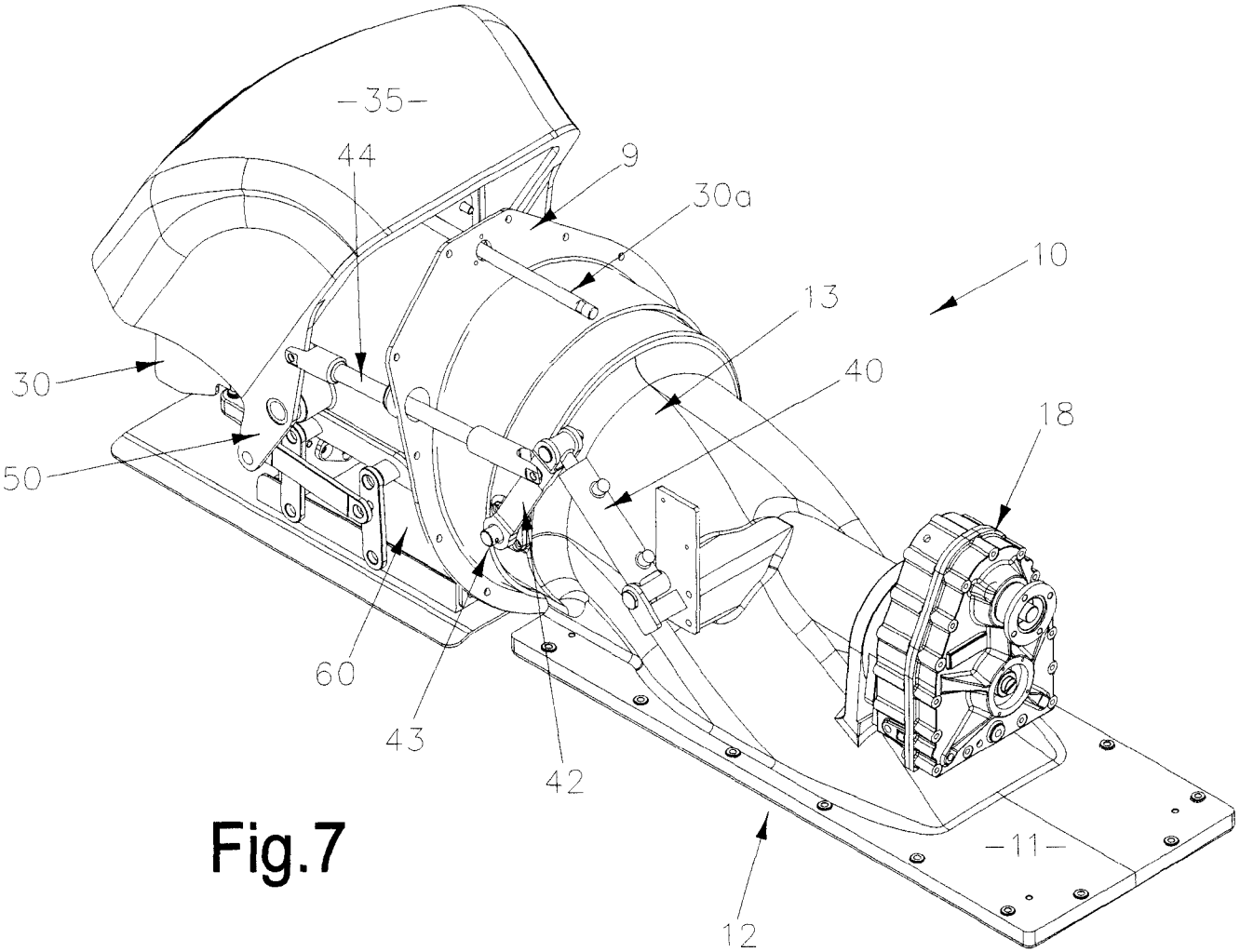
FIG. 7 is a view similar to FIG. 6, but from the front of the drive.

As shown in FIGS. 3 and 6, steering vanes 30 of known type are mounted at the rear of the drive, in known manner. The steering vanes 30 are conventional in design and are controlled by a control arm 30*a* in known manner. The centre steering vane 30 is omitted from FIG. 5.

An anti-ventilation hood 35 is pivoted to the rear of the housing 13 by pivots 36, one on each side of the hood. The hood 35 has an edge 37 adjacent the housing 13 which matches the seal 25*a* on the edge 25 of the sealing plate 24 such that when the hood 35 is in the position of FIG. 2 and the edge 37 rests against the edge 25, a substantially airtight seal is formed. The body of the hood 35 provides a smoothly curved surface terminating in a lower edge 38, which lies below the waterline when the drive is in use and the hood is in the position of FIG. 2.

Figure 2:
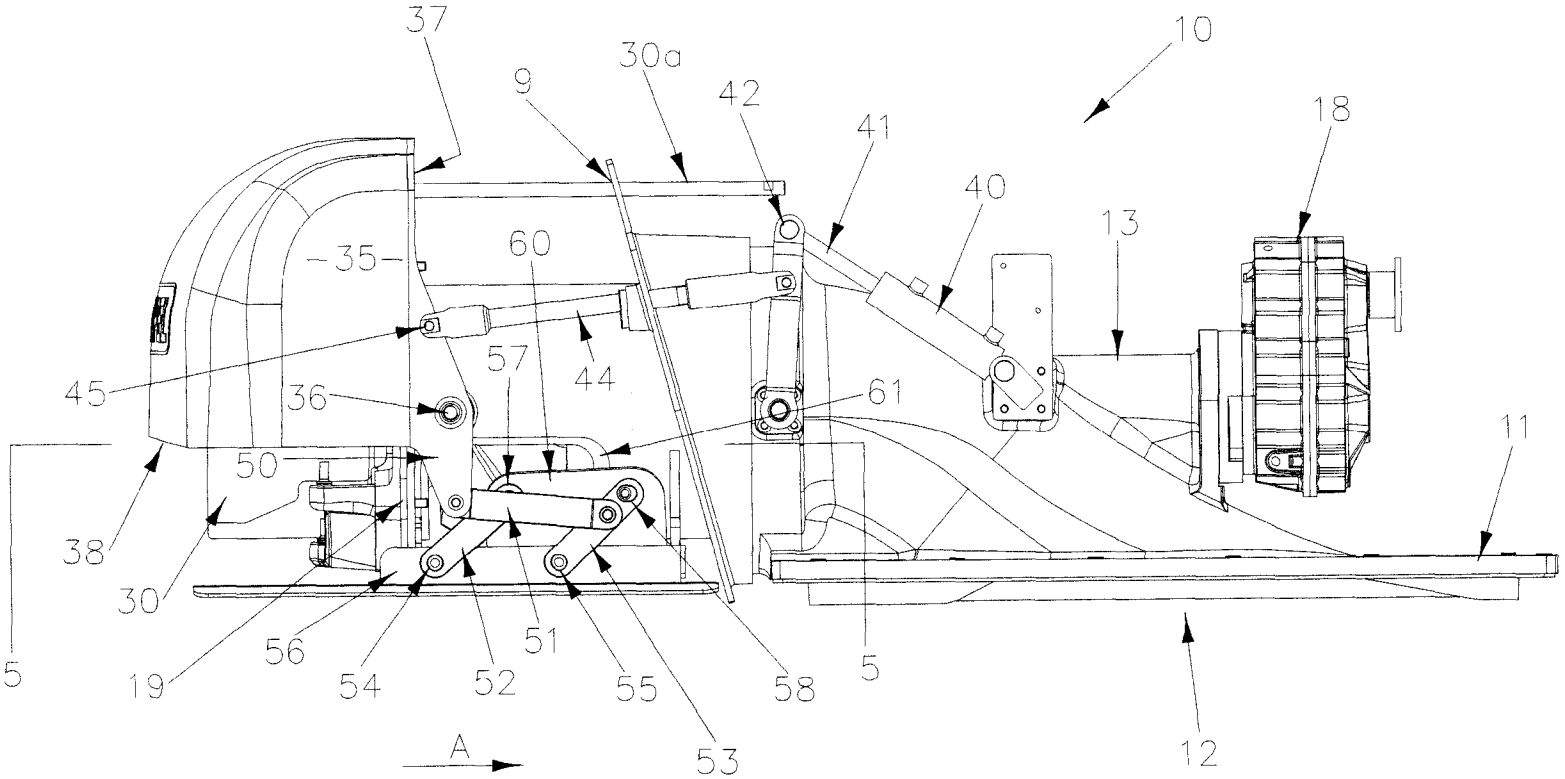
FIG. 2 is a side view of the present invention with the anti-ventilation hood in the second position.

The hood 35 is pivoted on the pivots 36 between the positions of FIGS. 1 and 2 by means of a hydraulic ram 40 which is mounted on the exterior of the housing 13. The piston 41 of the ram 40 is secured to one end of a first link 42 the other end of which is pivoted to the housing 13 at a pivot 43. A second link 44 is pivoted at one end to the first link 42 and at the other to the hood 35, by a pivot 45 which lies above the pivots 36. When the piston 41 of the ram 40 is contracted, as shown in FIG. 1, the links 42 and 44 are pivoted towards the ram 40, pivoting the hood 35 to the raised position shown in FIG. 1. In this position, the drive is set up for normal forward motion of the boat, and the hood 35 gives minimal impedance to water leaving the outlet 19.

When the piston 41 of the ram 40 is extended, as shown in FIG. 2, the links 42,44, are pivoted towards the outlet 19, pivoting the hood 35 to the position of FIG. 2, in which the edge 37 forms a seal against the seal 25*a* on the edge 25 of the sealing plate 24. In this position, the hood 35 prevents air from being sucked into the unit when it is run in reverse, as described below. Unless the unit is totally submerged, the anti-ventilation hood 35 is necessary, or air will be sucked into the unit when it is run in reverse.

To improve the efficiency of the drive when driven in reverse a bypass is provided as follows:—the hood 35 is formed with a pair of flanges 50 which extend below the lower edge 38 of the hood 35 on each side of the hood. The lower end of each flange 50 is pivoted to a link 51, the other end of which is pivoted to one of a pair of parallelogram links 52,53.

Each of the parallelogram links 52,53 is pivoted at its lower end by a pivot 54,55 to a plate 56 extending along the lower edge of the housing. The upper end of each of the parallelogram links 52,53 is pivoted by a pivot 57,58, to the adjacent side of a hatch 60 which is U-shaped in cross-section and which extends a short distance up each side of the housing adjacent the outlet 19, across the base of the unit and up the other side. The hatch 60 is arranged to cover an aperture 61 (visible in FIG. 2 only) which is formed in the base of the unit under/adjacent the impellers 14 and 15.

When the hood 35 is in the position of FIG. 1, the drive is set up for normal forward movement and the aperture 61 is closed and sealed against both air and water by the hatch 60. In this configuration, water enters the housing 13 through the inlet 12 and passes through the impeller 14 and then the impeller 15. The impeller 14 has blades which are pitched so that water is accelerated largely axially, and radial energy also is imparted to the water, introducing a spinning motion which does not perform any useful function when the water leaves the unit. Downstream impeller 15 is designed with opposite pitch blades and also rotates in the opposite direction; one of the functions of the downstream impeller is to remove the radial energy of the water, so that the accelerated water leaves the housing mainly in an axial direction.

Unless precautions are taken, in a dual impeller system, one impeller effects the other; this leads to a loss of efficiency and may even stall one of the impellers. This is discussed in detail in U.S. Pat. Nos. 7,448,926, 7,566,251, and 7,824,237. However, the techniques employed for ensuring that both impellers operate at maximum efficiency are set up on the basis of normal forward motion of the drive and it follows that when the water flow through the unit is reversed, in order to reverse the direction of the boat, the setup of the impellers is no longer effective and one impeller will act adversely on the other.

In particular, if the impellers are set up so that, in normal forward motion, the upstream impeller 14 imparts a greater energy to the water than the downstream impeller 15, (e.g. by a faster rate of rotation), when the flow is reversed, the now-upstream impeller 15 will now have a slower rate of rotation than the now—downstream impeller 14, so that the now-upstream impeller 15 will in fact tend to stall the now—downstream impeller 14, leading to a very great drop in efficiency.

It is to compensate for this effect that the bypass aperture 61 is provided, because the aperture 61 allows for an additional inflow of water into the space beneath the propellers 14 and 15 when the direction of flow through the unit is reversed. The unit will not act as efficiently in reverse drive as in forward drive, because the unit as a whole is designed to maximise efficiency in forward drive and the various features which make a positive contribution to efficiency in forward drive naturally tend to reduce efficiency in reverse drive. Nevertheless, the provision of the bypass in the form of the aperture 61 at least partly compensates for the problems which would otherwise be caused by the reverse flow through the unit.

As shown in FIG. 3, the bypass aperture 61 extends over a distance x from adjacent the outlet 19 to the position roughly midway between the impellers 14,15. However, the bypass aperture 61 may be extended right over the distance y, i.e. covering the whole distance between the outlet 19 and the upstream side of the impeller 14 in the direction of forward motion of the boat. Ideally, the distance over which the bypass aperture 61 extends should be sufficient that the area of the bypass aperture 61+the area of the outlet 19 is at least equal to the area of the impeller 14.

When the hood 35 is lowered to the position of FIG. 2, the links 51 move the parallelogram linkages 52,53 in the direction of arrow A and slide the hatch 60 to the position of FIG. 2. In this position, the bypass aperture 61 is fully open, so that water can enter the housing in the area under the impellers 14,15; this has the additional advantage compensating for the effect of the anti-ventilation cone 70 which is secured to the impeller 15. The use of an anti-ventilation cone, either secured to the impeller which is downstream in normal forward motion, or secured to the support spider 20, is known practice to stop air being sucked into the unit in normal forward motion. This tendency is due to the fact that as the water is accelerated through the two impellers, the water is pressed outwards towards the walls of the housing to form a doughnut shape, leaving a reduced pressure space in the centre of the water flow; without the anti-ventilation cone 70, air tends to be drawn into this space.

Obviously, when the water flow through the system is reversed, and the outlet 19 is used as an intake, the anti-ventilation cone 70 restricts the volume of water which can flow through that portion of the housing, and this restriction can cause the impellers to cavitate if the rate of rotation of the impellers is increased over a certain level. The provision of the bypass aperture 61 avoids this problem.

To return to normal forward motion, the direction of rotation of each shaft 16,17 is reversed using the gearbox 18, and the same time the hood 35 is raised to the position of FIG. 1, which raises the hood 35 clear of the outlet 19 and also draws the links 51 the direction of arrow B; the parallelogram links 52,53 over-centre in this position, to lock the hatch 60 in the closed position, preventing air or water from passing through the bypass aperture 61.

It will be appreciated that the anti-ventilation hood 35, and the hatch 60 could be moved independently of each other, and that although the hydraulic ram 40 has been found effective in moving both components, both components could be moved, either together or separately, by alternative means, for example, electric or magnetic actuators.

It will be appreciated that the hatch 60 may be moved over/away from the aperture 61 by any of a wide range of suitable mechanisms.

In the above described preferred embodiment, the drive is mounted at the rear of a boat, in the conventional manner. However, it should be noted that the device the subject of the present invention could be mounted on the sides or the front of a boat or other craft, or on wings extending outwards from the craft. Another possibility would be to mount devices in accordance with the present invention in an orientation perpendicular to that shown in the drawings, so that the devices could be used as steering devices.

The invention claimed is:

1. A high mass/low pressure liquid propulsion device which includes:

two counter-rotating impellers mounted inside a housing;

an inlet which in use allows inflow of liquid into the housing on a first side of said impellers;

an outlet which in use allows outflow of liquid from the housing on a second side of said impellers opposite to said first side;

means for driving said impellers;

wherein the improvement comprises the provision of means for reversing the drive to said impellers, such that the direction of flow of liquid through the device is reversed and liquid enters the device through said outlet, passes through said impellers, and leaves the device through said inlet;

further including a bypass located on the underside of said housing adjacent the impellers, said bypass having a first position in which said bypass is closed and does not permit air or liquid to pass through the bypass into the housing, and a second position in which said bypass is open and allows liquid to pass through into the housing.

2. The device as claimed in claim 1, further including an anti-ventilation hood mounted on the housing adjacent said outlet, said hood being movable between a first position in which said hood is clear of the outlet and a second position in which said hood provides a substantially air-tight cover over at least the upper portion of said outlet.

3. The device as claimed in claim 2, wherein in said second position, said hood seals against a seal adjacent the inner wall of the housing.

4. The device as claimed in claim 2, wherein said anti-ventilation hood and said bypass are connected such that as said hood is moved between said first and second positions, said bypass simultaneously passes between said first and second positions.

5. The device as claimed in claim 4, wherein said anti-ventilation hood and said bypass are moved between said first and second positions by a single moving means.

6. The device as claimed in claim 5, wherein said single moving means is selected from the group:—hydraulic cylinder, electric motor, magnetic actuator.

7. The device as claimed in any one of claims 1, 2, or 4, wherein said bypass includes an aperture formed in the lower part of the housing and a bypass hatch which is adapted to be moved between a first position in which the hatch covers the aperture and said bypass is closed, and a second position in which hatch is at least partially clear of the aperture and said bypass is open.

8. The device as claimed in claim 1, wherein each said impeller is mounted on a shaft for rotation therewith.

9. The device as claimed in claim 8, wherein said impellers are mounted upon concentric shafts.

10. The device as claimed in claim 1, wherein said means for reversing the drive to said impellers is selected from the group: a single motor arranged to drive via a gearbox; two reversible internal combustion motors; one or more reversible electric motors; one or more reversible hydraulic motors; one or more reversing magnetic drives.

11. The device as claimed in claim 1, wherein said device is a water propulsion drive.

* * * * *